US005983847A

United States Patent [19]

Miyoshi et al.

[11] Patent Number: 5,983,847

[45] Date of Patent: Nov. 16, 1999

[54] ELECTRIC VALVE DRIVE DEVICE IN AN INTERNAL COMBUSTION ENGINE

[75] Inventors: Noriomi Miyoshi; Kizuku Ohtsubo, both of Kawasaki, Japan

[73] Assignee: Fuji Oozx Inc., Japan

[21] Appl. No.: 09/226,696

[22] Filed: Jan. 7, 1999

[30] Foreign Application Priority Data

| | | | |
|---|---|---|---|
| Jul. 15, 1998 | [JP] | Japan | 10-200087 |
| Jul. 15, 1998 | [JP] | Japan | 10-200089 |
| Jul. 15, 1998 | [JP] | Japan | 10-200090 |
| Oct. 2, 1998 | [JP] | Japan | 10-281160 |

[51] Int. Cl.[6] ..... F07L 9/04

[52] U.S. Cl. ..... 123/90.11

[58] Field of Search ..... 123/90.11

[56] References Cited

U.S. PATENT DOCUMENTS 5,598,814 2/1997 Schroeder et al. ..... 123/90.11

FOREIGN PATENT DOCUMENTS

| | | | |
|---|---|---|---|
| 2063158 | 6/1972 | Germany | 123/90.11 |
| 10-141028 | 5/1998 | Japan . | |
| 10-37726 | 10/1998 | Japan . | |

*Primary Examiner*—Noah P. Kamen

*Attorney, Agent, or Firm*—Zarley, McKee, Thomte, Voorhees & Sease

[57] ABSTRACT

A poppet valve is provided to open and close a valve seat in an internal combustion engine. At the end of a valve stem of the valve, a cylindrical support is fixed, and on the outer circumferential surface of the support, a moving coil is wound. There is formed an annular cavity in a yoke fixed to a bracket fixed on a cylinder head, and a permanent magnet is fixed in the annular cavity of the yoke. Between the permanent magnet and the yoke in the annular cavity, the support which has the moving coil is inserted. By a control system having CPU, an electric current is applied to the moving coil, thereby providing optimum valve timing and lift to decrease seating noise and improving engine performance.

33 Claims, 5 Drawing Sheets

ELECTRIC VALVE DRIVE DEVICE IN AN INTERNAL COMBUSTION ENGINE

BACKGROUND OF THE INVENTION

The present invention relates to an electric valve drive device which opens and closes an intake or exhaust poppet valve electrically.

A valve drive system in an ordinary engine mainly comprises a cam shaft, a rocker arm (or a tappet), a valve spring and a valve spring retainer. Rotational force of a cam of the cam shaft driven by a crank shaft is transferred to a poppet valve via the rocker arm to make opening/closing movement.

Output performance and fuel efficiency of an engine generally depend on intake and exhaust efficiency, and the higher they are, the higher engine performance is obtained owing to smooth gas exchange in a cylinder.

However, an automobile engine has broad rotation range so that it is difficult to increase engine performance over the whole operation range. If high speed performance is increased, low speed performance is decreased, and if low speed performance is increased, high speed performance is decreased.

To solve the problem, there is high-speed valve timing wherein lifts of intake and exhaust valves become larger with a larger overlapping range to increase intake/exhaust efficiency. There is also a small overlapping range valve timing wherein lifts become smaller to form a strong swirl at low speed where combustion is likely to be unstable.

Recently, to meet such requirements, an engine which has a valve operating mechanism of both low and high speed performance, or a variable valve timing lift mechanism which has two valve timing and lifts for low and high speeds is utilized.

However, the variable valve timing lift mechanism is basically similar to the mechanical valve operating mechanism which has the above cam shaft as the drive source. It is thus impossible to remove the inherent performance decrease factor of the valve operating mechanism or performance decrease factor caused by mechanical loss and followability of a valve to a cam.

Valve timing and lift are determined by phase and profile of a cam. It is impossible to vary them over the whole working range of the engine. There is no choice but to set two valve timings and lifts for low and high speed as above.

To solve the problem, as disclosed in Japanese Patent Laid-Open Pub. Nos. 10-37726 and 10-141928, it has been suggested to provide an electromagnetic valve drive device in which a valve is opened and closed by magnetic force instead of mechanical valve drive system having a cam shaft. But, in such an electromagnetic valve drive device, the valve is merely opened and closed by the attractive force of an electromagnet, thereby increasing seating noise and providing low responsiveness during valve operation.

Furthermore, because the control range for valve timing and lift is small, it is difficult to obtain optimum valve timing and lift corresponding to any working condition of an engine, and it would be impossible to improve engine performance over the whole working range.

There is a moving iron core or piece in the valve, so that inertial mass is increased during opening and closing of the valve to decrease responsiveness and reliability at control.

To overcome the disadvantages in the foregoing electromagnetic valve drive device, the applicant suggested an electric valve drive device in which a valve is driven by an electromagnetic actuator called a voice coil motor. A moving coil in the electric valve drive device is repeatedly moved at high speed in an axial direction to drive a valve directly, so it is necessary to increase mounting strength to improve durability and reliability. Also, it is necessary to connect the ends of the moving coil to an input terminal and to keep durability of a lead for connecting a fixed terminal to a terminal of the moving coil which always moves. In the electric valve drive device, electric current intensity in the moving coil is controlled to obtain optimum valve timing and lift corresponding to the working condition of the engine, and thus, it is necessary to cool the moving coil to increase durability.

SUMMARY OF THE INVENTION

In view of the disadvantages, it is object of the present invention to provide an electric valve drive device which provides a low seating noise and high engine performance owing to larger control range of valve timing and lift with the weight of a moving portion being kept at minimum to increase responsiveness and reliability.

It is another object of the present invention to provide an electric valve drive device in an internal combustion engine in which mounting strength of a moving coil is increased to improve durability and reliability, with a terminal of the moving coil being easily connected to a terminal, and with durability of a lead for connecting terminals of moving and fixed sides being considerably improved.

It is a further object of the present invention to provide an electric valve drive device in which a moving coil is effectively cooled to improve durability.

To achieve the objects, according to the present invention, there is provided an electric valve drive device in an internal combustion engine, comprising:

- a cylindrical support which is fixed to an upper end of a valve stem of a poppet valve;
- a moving coil which is wound on an outer circumferential surface of said support; and
- a magnet which is mounted to a stationary part near the moving coil so that magnetic flux may be generated in a direction perpendicular to winding of the moving coil, said poppet valve being moved up and down at optimum valve timing and lift pattern when an electric current is applied to said moving coil.

BRIEF DESCRIPTION OF THE DRAWINGS

Other features and advantages of the present invention will become more apparent from the following description with respect to embodiments as shown in appended drawings wherein.

DETAILED DESCRIPTION OF THE INVENTION

Figure 1:
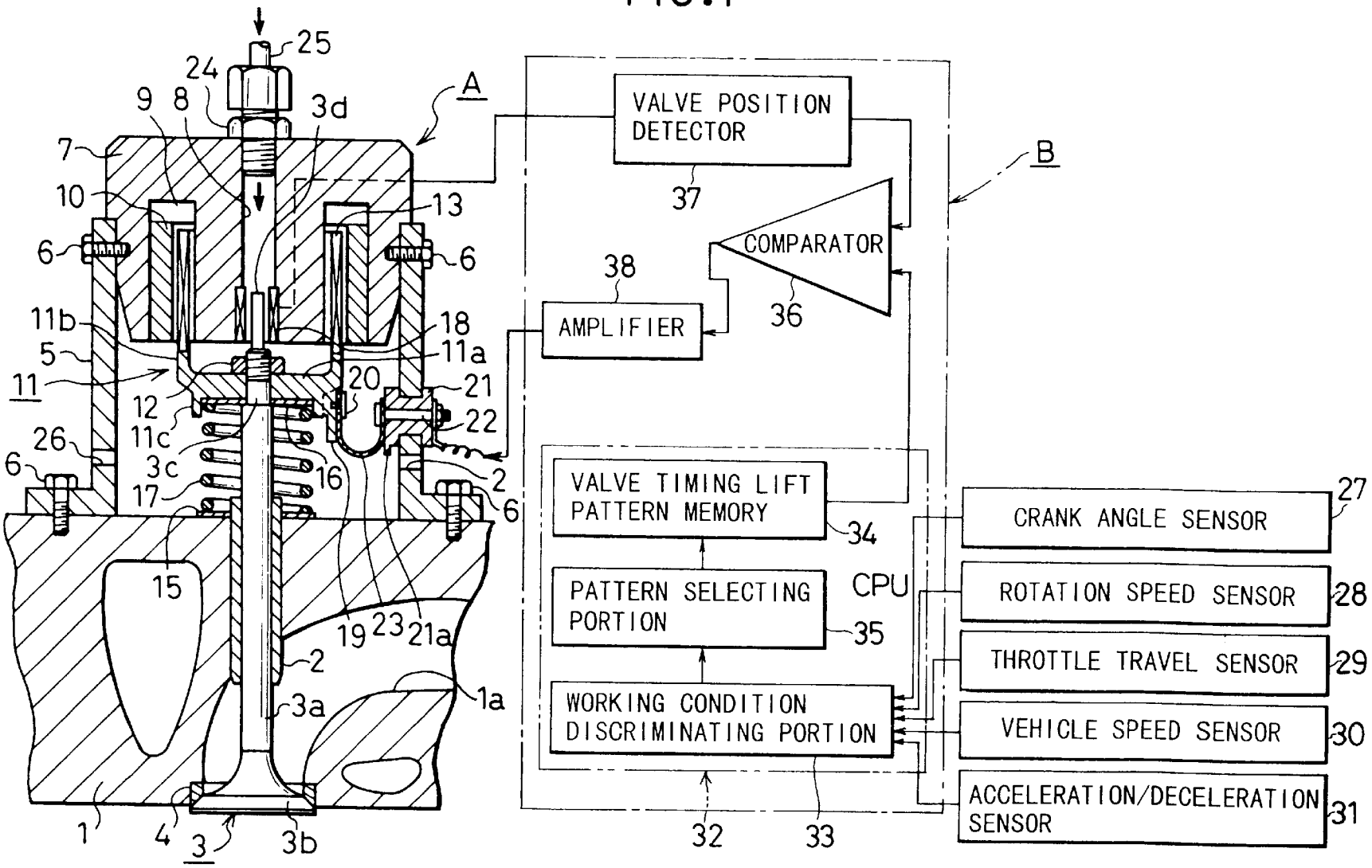
FIG. 1 is a central sectional front view of one embodiment of an electric valve drive device of the present invention and a block diagram which illustrates a control system therefor.

FIG. 1 illustrates and electric valve drive device "A" and a control system "B" therefor.

First, the valve drive device "A" will be described in detail. In a valve guide 2 which is a press fit in a cylinder head, a valve stem 3*a* of a heat resistant steel intake or exhaust poppet valve 3 is slidably engaged, and a valve head 3*b* at the lower end is engaged on a valve seat 4 which is a press fit in the opening end of an intake or exhaust port 1*a*, to seal the port 1*a*.

On the upper surface of the cylinder head 1, the lower end of a cylindrical bracket 2 is coaxial with the valve 3 and is fastened by a bolt 6. A magnetic steel yoke 7 is fixed in the upper end of the bracket 5 by a plurality of bolts 6.

The yoke 7 has a central vertical air supply bore 8 and an annular cavity 9 which is concentric to the valve 3, and opens at the lower end. On an outer diameter inner circumferential surface of the annular cavity 9, a cylindrical permanent magnet 10 which has an outer N-pole and an inner S-pole (or vice versa) is fixed to provide a certain gap in the annular cavity 9.

Around a smaller-diameter portion at the upper end of the valve stem 3*a* of the poppet valve 3 in the bracket 5, a bottom plate 11*a* of a cylindrical moving coil support 11 is fixed by a nut 12 which is engaged on a male thread at the upper end of the smaller-diameter portion 3*c*.

Figure 2:
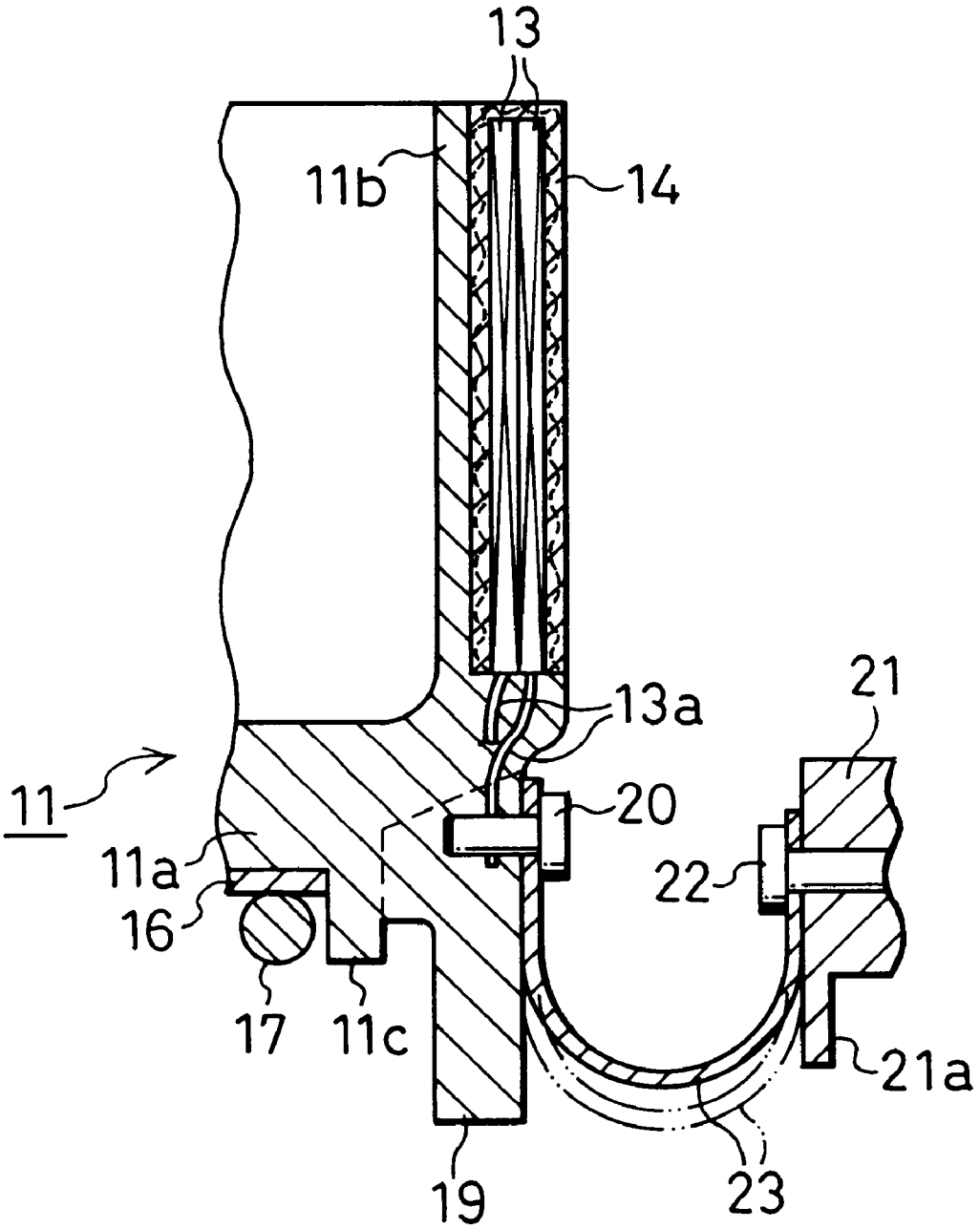
FIG. 2 is an enlarged vertical sectional view which shows the electric valve drive device and a moving coil wound thereon.

As shown in FIG. 2, a moving coil 13 is wound from the lower end in an axial direction on the outer circumferential surface of a thinner cylindrical bobbin 11*b* of the support 11 to constitute an even number of layers, such as two layers in this embodiment. The reason for an even number of layers is that both the beginning and terminal ends of the coil 13 come to the lower end of the bobbin 11*b* to facilitate connection to a terminal as described below. The bobbin 11*b* and the moving coil 13 are placed with a small space between the permanent magnet 10 and the yoke 7 in the annular cavity 9.

As shown in FIG. 2, the moving coil 13 is covered with a glass or carbon fiber 14 and then impregnated by thermosetting resin such as epoxy resin having high heat resistance and mechanical strength, so that the coil 13 thus covered is cured and integrally fixed to the bobbin.

In order to decrease inertial mass during opening and closing of the valve 3, the support may be preferably made of light metal, such as Al alloy or rigid synthetic resin.

The permanent magnet 10 and the moving coil 13 constitute an electromagnetic actuator called "voice coil motor". In a gap in which the bobbin 11*b*, around which the moving coil 13 is wound, is placed, magnetic flux is generated in a direction perpendicular to a winding of the moving coil 13. Thus, when the electric current is applied to the moving coil 13, a force is generated according to Fleming's left hand rule, and moves the support 11 axially. Therefore, by controlling an electric current which flows through the moving coil 13, the valve 3 can be moved optionally in a vertical direction. A compression spring 17 is provided between a washer 15 on the cylinder head 1 and a hard spring receiver 16, which is engaged on the lower surface of a bottom plate 11*a* of the support 11, so that the valve 3 is always biased upwards. The upper end of the compression spring 17 is prevented from horizontal displacement by a circumferential projection 11*c* of the bottom plate 11*a*.

When an electric current is not applied, the compression spring 17 prevents the valve 3 from going down owing to the self-weight of the valve 3, the mass of the support 11, and the moving coil 13 which is wound around it, to hold the valve 3 in a closed position. Thus, its spring constant may be smaller than that of a valve spring used in a valve operating mechanism of an ordinary engine.

At the lower end of the air supply bore 8 of the yoke 7, an electrode 18 for detecting position of the valve is fixed. In the linear displacement transducer 18, a smaller diameter sensor shaft or iron core 3*d* which projects at the upper end of the valve stem 3*a* of the valve 3 is positioned without contact to the inner circumferential surface of the transducer 18. The transducer 18 and the sensor shaft 3*d* constitute an electrostatic capacity valve position detector by which relative position of the yoke 7 and the sensor shaft 3*d* is detected to determine vertical displacement of the valve 3.

As shown in FIG. 2, terminals 13*a*, 13*a* of the moving coil 13 are put in a guide portion 19 which projects downwards at the outer circumferential surface of the support 11, and is connected to a pair of terminal pins 20.

The terminal pin 20 is connected to a terminal pin 22 of an input terminal 21 mounted to the bracket 5 via a U-shaped flexible metal lead 23 made of phosphorous bronze. The metal lead 23 is curved between the guide portion 19 and a guide portion 21*a* of the input terminal 21.

Into the air supply bore 8 of the yoke 7, cooling compressed air is fed through a connector 24 which is engaged in the bore 8 and an air pipe 25 connected therewith. Compressed air which flows in the bore 8 flows into the bracket 5 through a gap between the bobbin 11*b* and the yoke 7 and a gap between the outer circumferential surface of the moving coil 13 and the permanent magnet 10, and is discharged to the outside through a plurality of holes 26 of the bracket 5. By such air flowing, the transducer 18 and the moving coil 13 are cooled, thereby preventing overheating.

Compressed air may be fed from an air pump which is driven by an engine or an air tank.

Next, with respect to a block diagram in FIG. 1, the control system "B" for the valve drive device "A" will be described.

The working condition of the engine is detected by a plurality of sensors including a crank angle sensor 27 mounted to the engine or vehicle and including a crank angle basic position sensor and a cylinder identifying sensor, an engine rotation speed sensor 28, a throttle travel sensor 29, a vehicle speed sensor 30 and an acceleration/deceleration sensor 31, and other sensors (not shown). An optimum valve position electric signal thus obtained is inputted to a working condition discriminating portion 33 in CPU 32 of a microcomputer.

Figure 3:
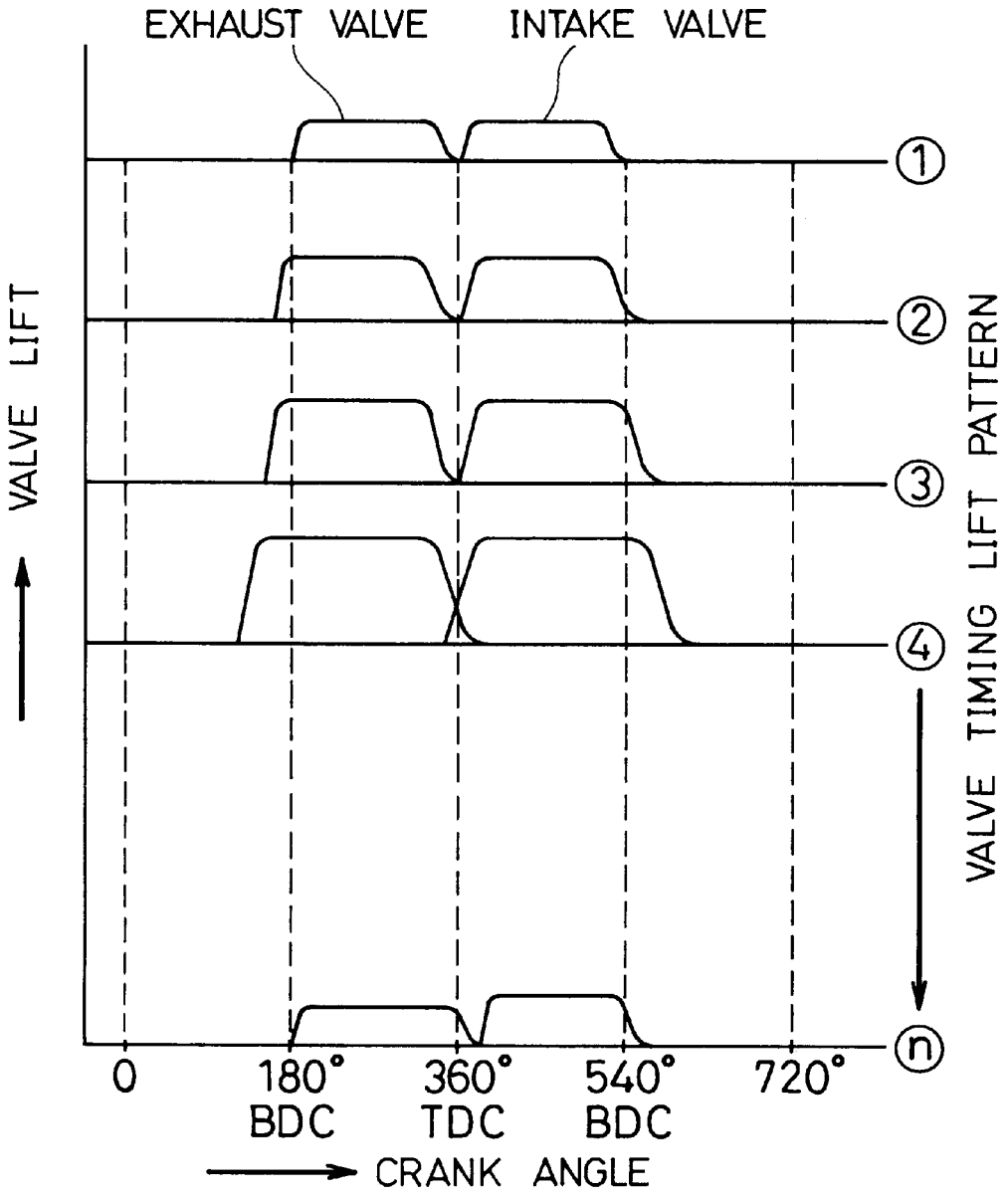
FIG. 3 is a graph which shows one example of a valve timing and lift.

As shown in FIGS. 1 and 3, CPU 32 has a valve timing lift pattern memory 34 in which an optimum valve timing lift pattern is previously set corresponding to an engine working condition in a map of ① to (n) and stored in ROM, and a valve timing lift pattern selecting portion 35 for selecting optimum valve timing and lift determined based on the working condition discriminating portion 33 from the memory 34.

The optimum valve position electric signal selected from the valve timing lift pattern memory 34 is inputted to a comparator 36 to indicate an optimum position of the valve 3. The actual valve position electric signal which is outputted from the transducer 18 is converted to an electric signal corresponding to an exact valve position by a valve position detector 37 and inputted to the comparator 36.

In the comparator 36, the optimum valve position signal called out by the valve timing lift pattern memory 34 and the actual valve position signal from the transducer 18 are compared and calculated, so that the valve 3 is driven without causing a difference between the two position signals. That is to say, to identify the two position signals, intensity and direction of an electric current which flows through the moving coil are controlled with feed-back by the amplifier 38 connected to the input terminal 21, and the moving coil 13 and the support 11 are moved up and down, so that the valve 3 is driven with optimum timing and lift which is selected from the valve timing lift pattern memory 34.

The valve position detector 37 contains a wholly closed correcting detector for detecting the upper limit position and resetting to show the closed position any time when the valve is closed to exact lift from the wholly closed position of the valve 3, thereby preventing error of the present position caused by thermal expansion of the valve 3 and preventing wear in a valve face.

In a multiple-cylinder engine, the control system "B" is provided in each of intake and exhaust valves of each cylinder to drive the intake or exhaust valve 3 separately.

As mentioned above, the electric valve device drive "A" of the present invention moves the moving coil 13 fixed to the axial end of the valve 3 in an axial direction to drive the valve 3, thereby avoiding necessity of a heavy iron core on the moving valve 3, as in a conventional valve drive device for which attracting force by an electromagnet is used. Therefore, inertial mass is decreased during opening and closing of the valve to decrease seating noise of the valve and to increase responsiveness and reliability.

By controlling intensity and direction of the electric current in the moving coil 13, valve timing and lift can be optionally controlled, thereby increasing its control area considerably, compared with a conventional electromagnet type device.

The electric valve drive device "A" contains a compression spring 17 which always biases the valve to a closed position, thereby preventing engagement of the valve 3 with the piston when an electric current is not applied to the moving coil 13, owing to inertia rotation after the engine stops with "off" of the engine and electric failure.

The air supply bore 8 is formed in the center of the yoke 7, and compressed air introduced in the bore 8 is discharged to the outside via the holes 26 of the bracket 5 through a gap between the permanent magnet 10 and the moving coil 13, so that the moving coil 13 is directly cooled by air, thereby preventing rise in temperature.

The moving coil 13 comprises an even number of layers so that both beginning and terminal ends of the coil 13 are positioned to the same place, thereby facilitating connection with the terminal pin 20 or the input terminal 21.

The moving coil 13 is covered with glass or carbon fiber 14 and is impregnated with epoxy resin to cure, thereby increasing not only heat resistance but also tension and bending strengths, with increased vibration endurance.

The terminal pin 20 of the moving coil 13 is connected to the terminal pin 22 of the input terminal 21 via the flexible elastic metal lead 23, so that curvature is flexible when the support 11 moves up and down, thereby avoiding stoppage of electric current to the moving coil 13 caused by breakage of the metal lead 23.

The valve drive device "A" is controlled by the control system "B" in the foregoing embodiments to open and close the valve 3 with optimum valve timing and lift pattern as previously set, considering any working conditions of the engine, thereby expanding control area considerably and increasing output performance, fuel efficiency and exhaust gas performance over the whole working range of the engine.

As shown in FIG. 3, the lift pattern during closing of the valve 3 is set to gently sloping, thereby decreasing seating noise by a buffer effect when the valve 3 is seated.

The intake valve 3 itself can control the intake amount of a mixed gas, thereby omitting a throttle valve.

Control of lift of the exhaust valve 3 to a minimum level during deceleration increases brake efficiency owing to an exhaust brake.

In the electric valve drive device "A", the permanent magnet 10 may be provided inside the moving coil 13.

After a key switch of the engine turns off, there may be provided a reserve power source for moving the moving coil 13 in a closing direction of the valve 3.

The compression spring 17 may be omitted in case of a horizontally opposing engine.

In the foregoing embodiment, an electrostatic capacity type sensor which comprises the transducer 18 and the sensor shaft 3*d* is used without suffering magnetic effect as the valve position detector is used. Alternatively, an eddy-current type sensor may be used.

Figure 4:
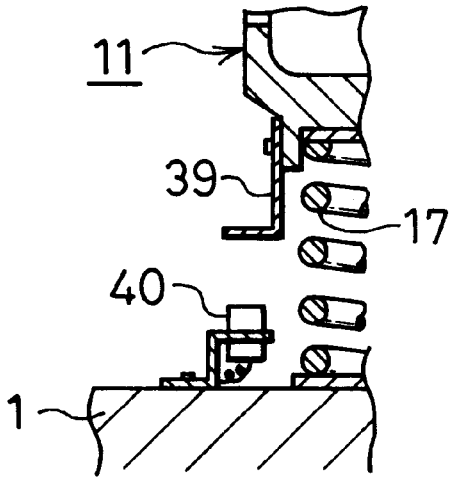
FIG. 4 is an enlarged vertical sectional view of a variation of means for detecting displacement of a valve.

In the embodiment, displacement of the axial end of the valve 3 is detected, but as shown in FIG. 4, a detecting metal piece 39 is mounted to the lower end of the support 11, and vertical displacement may be detected by a magnetic sensor 40 to detect displacement of the valve 3 indirectly.

Figure 5:
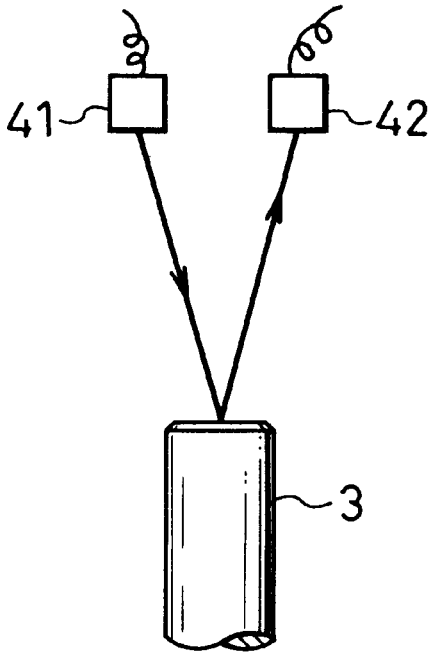
FIG. 5 is an embodiment of means for optically detecting displacement of a valve.

Instead of the foregoing detecting means, as shown in FIG. 5, displacement of the valve 3 may be detected by an optical sensor which comprises a light emitting portion 41 such as a laser and a light receiving portion 42. An ultrasonic wave may be transmitted to the axial end to detect displacement of the valve 3 directly. (not shown)

Instead of the permanent magnet 10 which constitutes the electromagnetic actuator, an electromagnet may be used.

The air supply bore 8 for cooling the moving coil 13 is not formed at the center of the yoke 7, but a plurality of air supply bores may be formed in the yoke 7 about the moving coil 13, or an air supply or discharge bore may be formed in the bracket to discharge heat of the bracket 5.

Figure 6:
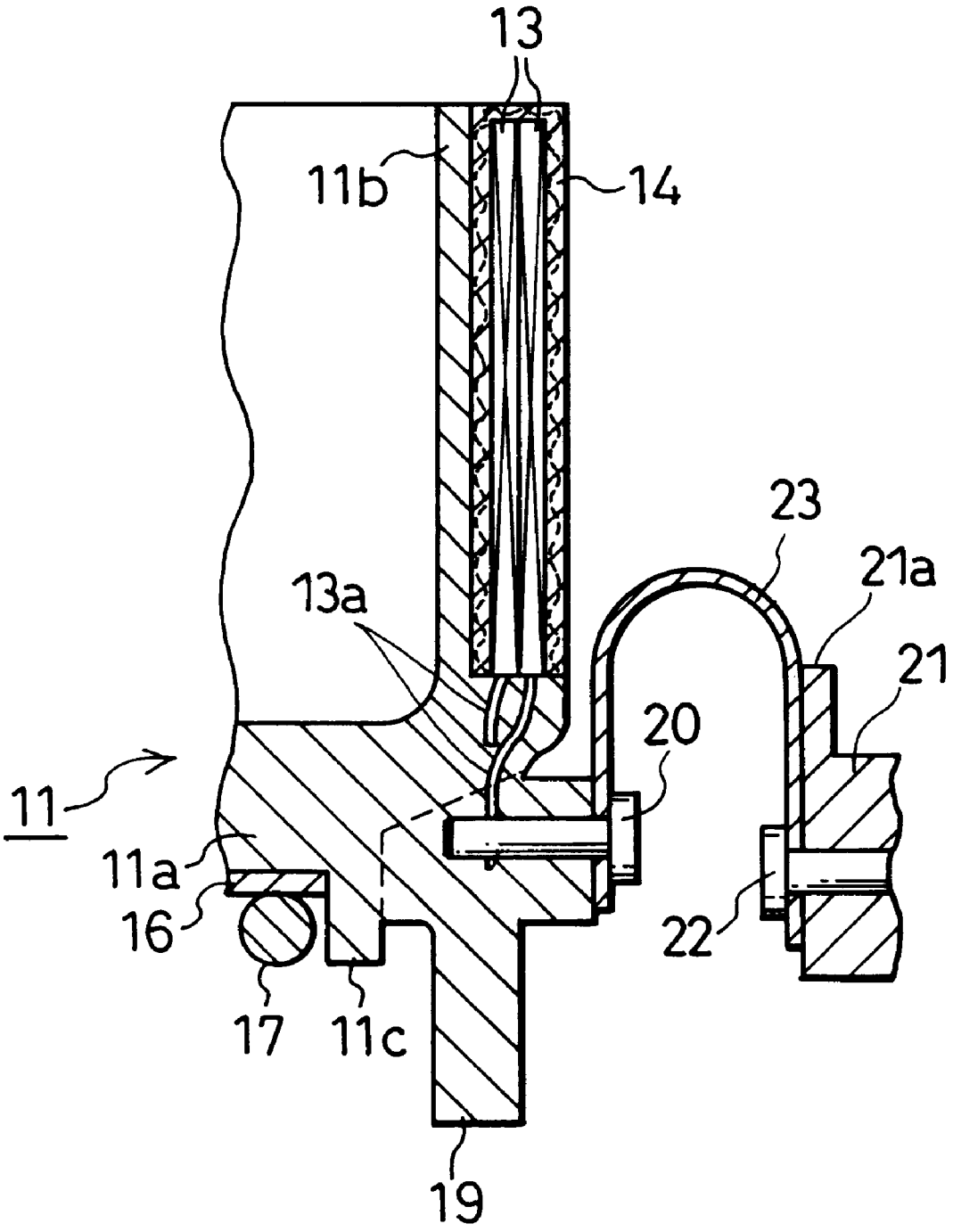
FIG. 6 is an enlarged vertical sectional view of a variation of a metal lead.

In the foregoing embodiment as shown in FIG. 2, the metal lead 23 comprises a U-shape, but may comprise an inverted U-shape in which a guide piece 21 is provided, as shown in FIG. 6. At the beginning of opening of the valve 3 wherein the maximum acceleration acts, tension-directed force (compression-directed force in the foregoing embodiment) is applied to a curved portion of the metal lead 23, thereby flexing the curvature of the metal lead 23 to increase durability considerably.

The foregoing merely relate to embodiments of the invention. Various modifications and changes may be made by person skilled in the art without departing from the scope of claims wherein:

What is claimed is:

1. An electric valve drive device in an internal combustion engine, comprising:

a cylindrical support which is fixed to an upper end of a valve stem of a poppet valve;

a moving coil which is wound on an outer circumferential surface of said support;

a magnet which is mounted to a stationary part near the moving coil so that magnetic flux may be generated in a direction perpendicular to winding of the moving coil, said poppet valve being moved up and down when an electric current is applied to said moving oil;

the stationary part comprising a yoke which is fixed to a cylinder head via a cylindrical bracket; and the voke having an annular cavity which is concentric to the valve and opens at a lower end in which the support is placed.

2. The electric valve drive device as defined in claim 1 wherein said magnet comprises a permanent magnet.

3. The electric valve drive device as defined in claim 1 wherein an electrode is provided on the yoke, a sensor shaft of the valve stem being provided in the electrode with a space to detect actual valve position to transmit an electric signal corresponding to the actual valve position to a control system.

4. The electric valve drive device as defined in claim 3 wherein said electrode is fixed on an inner circumferential surface of an air supply bore which is formed in a center of the yoke, said sensor shaft being formed at an upper end of the valve stem and inserted in the electrode with a space.

5. The electric valve drive device as defined in claim 4 wherein said beginning and terminal ends of the moving coil are connected to an input terminal via a metal lead which can be deformed like rolling.

6. The electric valve drive device as defined in claim 5 wherein said metal lead comprises U-shape.

7. The electric valve drive device as defined in claim 5 wherein said metal lead comprises an inverted U-shape.

8. The electric valve drive device as defined in claim 5 wherein an electric signal is applied to the moving coil via said input terminal from the control system.

9. The electric valve drive device as defined in claim 4 wherein compressed air is supplied via the air supply bore to cool the electrode and the moving coil.

10. The electric valve drive device as defined in claim 1 wherein said moving coil comprises an even number of layers so that beginning and terminal ends of winding of the moving coil may come to the same position.

11. The electric valve drive device as defined in claim 10 wherein said moving coil comprises two layers.

12. The electric valve drive device as defined in claim 1 wherein a compression spring is provided around the valve stem between the support and an upper surface of the cylinder head, thereby keeping the valve in a closed position.

13. The electric valve drive device as defined in claim 1 wherein the support is made of light metal or synthetic resin.

14. The electric valve drive device as defined in claim 1 wherein the moving coil is covered with light metal or synthetic resin and impregnated in thermosetting resin, so that the coil is cured and integrally fixed to the support.

15. The electric valve drive device as defined in claim 1 wherein a detecting piece is mounted to the support so that vertical displacement of the valve may be detected by a magnetic sensor on the cylinder head.

16. The electric valve drive device as defined in claim 1 wherein vertical displacement of the valve is detected by an optical sensor which comprises light emitting and receiving portions.

17. An electric valve drive device in an internal combustion engine, comprising:

a cylindrical support which is fixed to an upper end of a valve stem of a poppet valve;

a moving coil which is wound on an outer circumferential surface of said support;

a magnet which is mounted to a stationary part near the moving coil so that magnetic flux may be generated in a direction perpendicular to winding of the moving coil, said poppet valve being moved up and down when an electric current is applied to said moving oil; and the moving coil being covered with light metal or synthetic resin and impregnated in thermosetting resin, so that the coil is cured and integrally fixed to the support.

18. The electric valve drive device as defined in claim 17 wherein the support is made of light metal or synthetic resin.

19. The electric valve drive device as defined in claim 17 wherein said moving coil comprises an even number of layers so that beginning and terminal ends of winding of the moving coil may come to the same position.

20. The electric valve drive device as defined in claim 19 wherein said moving coil comprises two layers.

21. The electric valve drive device as defined in claim 17 wherein the stationary part comprises a yoke which is fixed to a cylinder head via a cylindrical bracket.

22. The electric valve drive device as defined in claim 21 wherein a compression spring is provided around the valve stem between the support and an upper surface of the cylinder head, thereby keeping the valve in a closed position.

23. The electric valve drive device as defined in claim 21 wherein a detecting piece is mounted to the support so that vertical displacement of the valve may be detected by a magnetic sensor on the cylinder head.

24. The electric valve drive device as defined in claim 21 wherein vertical displacement of the valve is detected by an optical sensor which comprises light emitting and receiving portions.

25. The electric valve drive device as defined in claim 21 wherein the yoke has an annular cavity which is concentric to the valve and opens at a lower end in which the support is placed.

26. The electric valve drive device as defined in claim 25 wherein said magnet comprises a permanent magnet.

27. The electric valve drive device as defined in claim 25 wherein an electrode is provided on the yoke, a sensor shaft of the valve stem being provided in the electrode with a space to detect actual valve position to transmit an electric signal corresponding to the actual valve position to a control system.

28. The electric valve drive device as defined in claim 27 wherein said electrode is fixed on an inner circumferential surface of an air supply bore which is formed in a center yoke, said sensor shaft being formed at an upper end of the valve stem and inserted in the electrode with a space.

29. The electric valve drive device as defined in claim 28 wherein compressed air is supplied via the air supply bore to cool the electrode and the moving coil.

30. The electric valve drive device as defined in claim 28 wherein said beginning and terminal ends of the moving coil are connected to an input terminal via a metal lead which can be deformed like rolling.

31. The electric valve drive device as defined in claim 30 wherein said metal lead has a U-shape.

32. The electric valve drive device as defined in claim 30 wherein said metal lead comprises an inverted U-shape.

33. The electric valve drive device as defined in claim 30 wherein an electric signal is applied to the moving coil via said input terminal from the control system.

* * * * *